US010694593B2

(12) United States Patent
Takacs

(10) Patent No.: US 10,694,593 B2
(45) **Date of Patent: *Jun. 23, 2020**

(54) DYNAMIC POWER SUPPLY FOR LIGHT EMITTING DIODE

(71) Applicant: Soraa, Inc., Fremont, CA (US)

(72) Inventor: Laszlo Takacs, Fremont, CA (US)

(73) Assignee: ECOSENSE LIGHTING, INC., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/168,387

(22) Filed: Oct. 23, 2018

(65) Prior Publication Data

US 2019/0174589 A1 Jun. 6, 2019

Related U.S. Application Data

(63) Continuation of application No. 14/944,097, filed on Nov. 17, 2015, now Pat. No. 10,154,552.

(60) Provisional application No. 62/191,831, filed on Jul. 13, 2015.

(51) Int. Cl.
*H05B 33/08* (2020.01)

(52) U.S. Cl.
CPC ..... *H05B 33/0815* (2013.01); *H05B 33/0818* (2013.01)

(58) Field of Classification Search
CPC ..... H05B 33/0815; H05B 33/0845; H05B 33/089; H05B 33/0827; H05B 33/083; H05B 37/0272; H05B 33/0851
USPC ..... 315/34, 200 R, 297, 51, 307, 294
See application file for complete search history.

(56) References Cited

U.S. PATENT DOCUMENTS

| | | | | |
|---|---|---|---|---|
| 9,301,348 | B2 | 3/2016 | Saes | |
| 9,791,110 | B2 * | 10/2017 | Hu | F21K 9/64 |
| 2007/0182347 | A1 | 8/2007 | Shteynberg | |
| 2008/0030143 | A1 | 2/2008 | Goriki | |
| 2010/0026208 | A1 * | 2/2010 | Shteynberg | H05B 33/0815 315/297 |
| 2010/0164403 | A1 | 7/2010 | Liu | |
| 2011/0140621 | A1 | 6/2011 | Yi | |
| 2011/0248648 | A1 | 10/2011 | Liu | |
| 2011/0285526 | A1 * | 11/2011 | Tanaka | H05B 33/0884 340/514 |
| 2012/0229041 | A1 | 9/2012 | Saes | |
| 2013/0076245 | A1 * | 3/2013 | Phadke | H05B 33/0887 315/121 |
| 2015/0289325 | A1 * | 10/2015 | Szolusha | H05B 33/08 315/201 |
| 2015/0312983 | A1 * | 10/2015 | Hu | F21K 9/64 315/186 |

* cited by examiner

*Primary Examiner* — Wei (Victor) Y Chan
(74) *Attorney, Agent, or Firm* — FisherBroyles LLP

(57) ABSTRACT

A voltage control system for an LED operates to dynamically determine and set a minimum permissible voltage on an energy storage device such as a capacitor such that the energy storage device operates at a minimum possible voltage to compensate for component variations and dimming signal variations while maintaining flicker-free operation of the LED.

15 Claims, 6 Drawing Sheets

DYNAMIC POWER SUPPLY FOR LIGHT EMITTING DIODE

CROSS-REFERENCE TO RELATED APPLICATIONS

This application is a continuation of U.S. application Ser. No. 14/944,097, filed Nov. 17, 2015, which claims the benefit of U.S. Provisional Application No. 62/191,831, filed Jul. 13, 2015, the entire disclosure of which is incorporated herein by reference.

FIELD OF INVENTION

The subject matter herein relates generally to an electrolytic capacitor management system for lighting applications.

BACKGROUND

A conventional power supply for an LED lamp takes power from an input line at one voltage (typically 12V AC 50/60 Hz) and converts it to a higher DC voltage (e.g., 30 V DC) to power the LEDs. The temporal characteristics of the power signal directly impact the quality of the light generated by the LED. Thus, the power supply also regulates the current to the LEDs to provide consistent lighting output.

Due due to the zero crossings of the AC signal, which occur at twice the AC frequency, the power supplied to the LED is momentarily at zero. This leads to what is referred to as systematic flicker, which although may not be directly observable, nonetheless leads to perceptible degradation in the quality of the light generated by the LED. During these very low voltage points of the AC input or when the AC input is interrupted by a phase-cut dimmer, it is desirable to continue to provide power to the LEDs to prevent stroboscopic flicker.

In addition, noise and other disturbances in the electric power signal also degrade the performance of sourced LEDs. Thus, it is desirable to mitigate any noise or other power line disturbances in the power signal.

In order to alleviate both systematic flicker, power line disturbances and noise, an energy storage device such as a capacitor may be introduced between the power source and the LED. The energy storage device acts as a buffer and is designed to have enough capacity to continue to power the LED while the AC signal crosses zero. In general, the higher the voltage established on the energy storage device, the more immune the power supply is to systematic flicker and power line disturbances. Preferably, this solution utilizes a two-stage approach comprising a first stage introduced before the energy storage device and a second stage introduced after the energy storage device.

The first stage may be a voltage converter, which functions to fill the energy storage device. This converter allows for optimized input power draw from the line (high power factor ("P.F.") for example). Because boost converters have significantly better P.F. than buck converters, they are used almost exclusively as the first power conversion stage in a two-stage arrangement. The intermediate DC voltage on the storage capacitor (output of the first stage) must be approximately twice the input RMS voltage for the boost converter to have high P.F.

The second stage may also be a voltage converter, which functions to draw energy from the energy storage device to drive an LED. The second stage allows for a highly uniform low or zero-ripple output to the LEDs. The second stage is typically a buck stage, which functions to reduce the voltage level at the storage capacitor down to the level of the LED with output current regulation as the main operating mode.

In this arrangement, the higher the intermediate voltage, the smaller the required storage capacitance to hold the LEDs up through the dropout periods. However, as this voltage is increased, each converter becomes less efficient. In very small lamps such as the MR16, this leads to a very challenging tradeoff between efficiency, cost, and lamp size. Typical efficiencies for boost and buck converters with 3:1 transformation ratios might be ~87%. The net efficiency of this combination is thus ~75%, a significant reduction.

With a buck stage, the input voltage must be higher than the output. Generally speaking, in the prior art the nominal voltage at which this capacitor operates is a fixed parameter such as 45 Volts. In some conventional power supplies, the intermediate capacitor voltage can vary but usually does so as a function of the type of power grid to which it is connected. For example, some power supplies allow the intermediate capacitor voltage to be 240 VDC when the input voltage is 120 VAC, and allow the capacitor voltage to rise to 380 VDC when the input voltage is 230 VAC. Most prior art two-stage power supplies fix the capacitor voltage (in this example) to the higher of the two (380 VDC) to allow the device to operate from either input voltage. (It is not permissible in this example for the input voltage to be 230 VAC while the output voltage is 240 VDC.)

FIG. 1 shows a conventional two-stage driver. Input power source 110 provides alternating voltage ("AC") signal AC (not shown in FIG. 1). Two-stage driver 100 comprises boost stage 104 and buck stage 106. AC/DC converter 130 converts AC signal generated from input power source 110 to a DC signal (not shown in FIG. 1), which is provided to boost stage 104. Boost stage 104 may further comprise inductor 134(1), diode 132(2) and switch 136(1). Boost stage 104 performs voltage conversion of the DC signal generated by AC/DC converter 130 to generate an output voltage signal (not shown in FIG. 1). The output voltage signal from boost stage 104 is provided to capacitor 112, which stores energy in electromagnetic form.

Buck stage 106 draws energy from capacitor to power LED 108. Buck stage 106 may further comprise inductor 134(2), diode 132(2) and switch 136(2).

The input power of boost stage 104 is controlled by capacitor voltage control system 102 so that under typical operating conditions, the capacitor voltage (average, peak or some other measure) is held constant. The lowest undulation of the capacitor voltage must always be higher than the forward voltage of LED 108 in order to maintain the flicker-free output condition.

Eventually capacitor 112 ages and its capacitance is insufficient to prevent output ripple or possibly severe flicker. Also, there is typically a design margin required on the set-point of the capacitor voltage (perhaps 25% higher than the LED voltage), which can significantly reduce the efficiency.

Applicant has identified significant shortcomings in the conventional driver 100 as depicted in FIG. 1. First, although the cascaded efficiency reduction of two power converters may be tolerable in applications in which the power supply is not inside a LED or lamp, inside an LED or lamp, the thermal conditions usually limit or define the performance envelope of the lamp. Furthermore, the lifetime of the electrolytic capacitor 112 decreases exponentially with operating temperature. For example, a power supply with a capacitor, which operates at a temperature of 40 C may last in principle for 150 continuous years of service or more before its electrolytic capacitor wears out. That same capacitor in a lamp operating above 100 C may last only 1/60th as long, only a few short years. In a typical two-stage power supply, when the capacitor's value drops below a certain design level (due to this aging process) it will no longer meet its specifications or may malfunction in an unpredictable way. The present invention addresses many of these shortcomings and fulfills one or more of these needs among others.

SUMMARY OF INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The disclosed invention permits both the efficiency of the light emitting diode (LED) to be maximized, while monitoring capacitor life. In addition, the invention allows reasonable action to be taken at the inevitable end of capacitor life to ensure acceptable lamp performance following the capacitor's failure. In one embodiment, the invention comprises both a monitoring and control system to dynamically regulate the voltage of the capacitor. The regulation configuration operates the capacitor at minimum possible voltage to maximize the efficiency, to compensate for component variations and dimming signal variations, while maintaining flicker-free LED output.

For example, in one embodiment, a power supply for powering the LED comprises: (a) a capacitor; (b) a first voltage converter electrically coupled to an input voltage source and the capacitor; (c) a second voltage converter electrically coupled to the LED and the capacitor; and (d) a voltage control system, wherein the voltage control system controls a voltage established on the capacitor based upon a comparison of a voltage established on a cathode of the LED with a reference voltage source.

DETAILED DESCRIPTION

Figure 1:
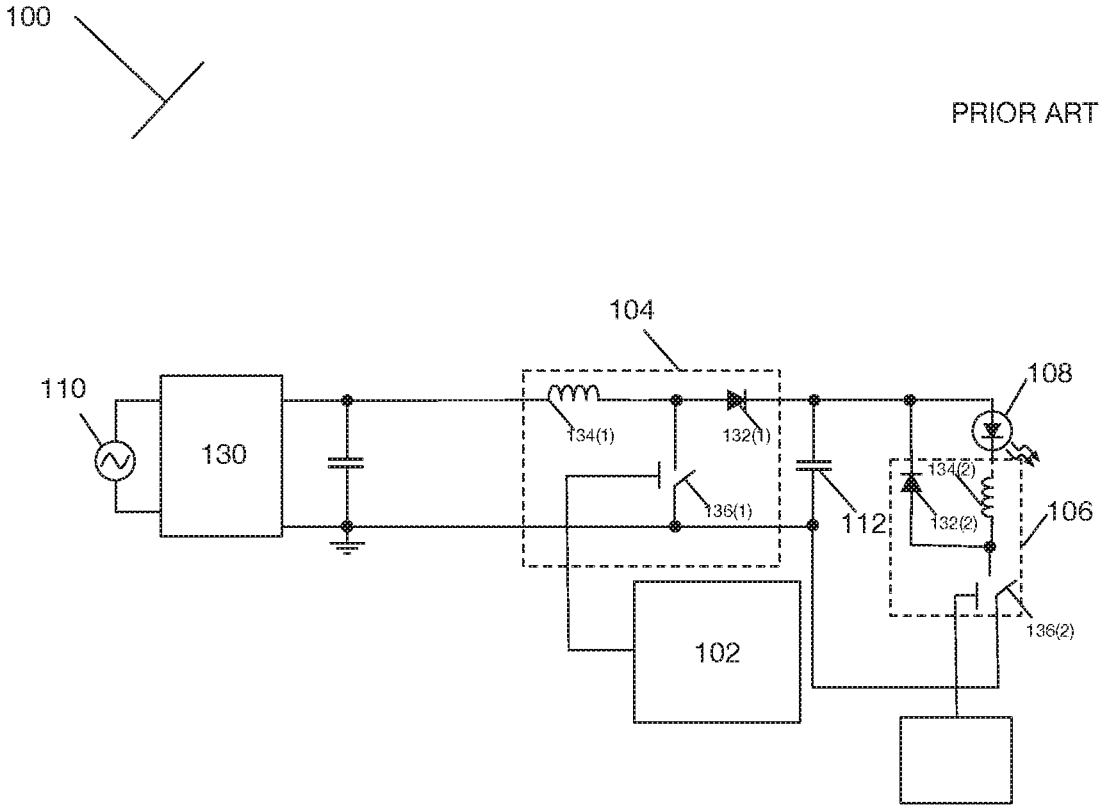
FIG. 1, which is prior art, shows a conventional two-stage driver.
Figure 2A:
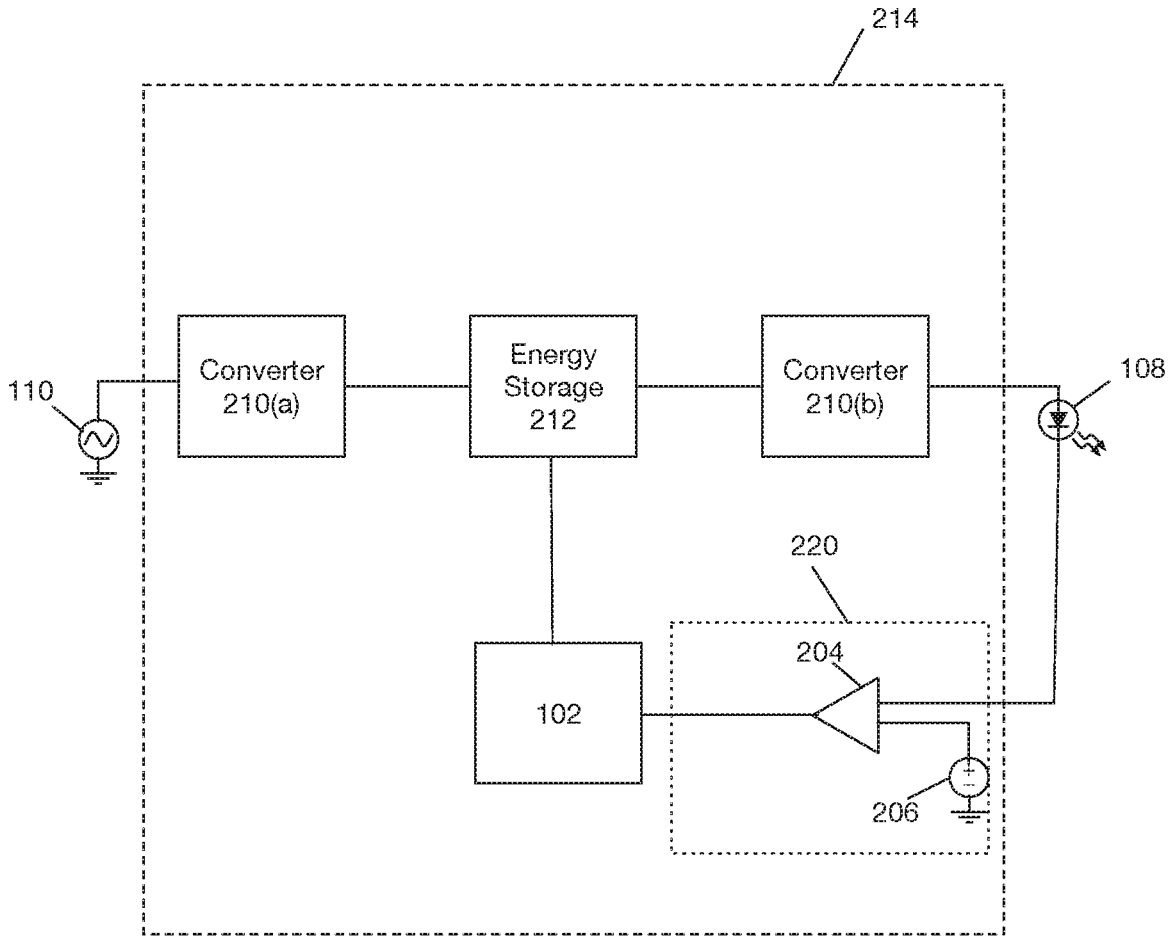
FIG. 2A is a block diagram of a two stage driver and a power management system according to one embodiment.

FIG. 2A is a block diagram of a dynamic power supply for powering an LED incorporating dynamic adjustment of an energy storage device according to one embodiment. As shown in FIG. 2A, dynamic power supply 214 comprises energy storage device 212, first voltage converter 210(*a*), second voltage converter 210(*b*), voltage control system 102 and detector 220. Energy storage device 212 may be a capacitor or other device for storing energy in electromagnetic or other form. First voltage converter 210(*a*) is electrically coupled to input voltage source 110 and energy storage device 212. Second voltage converter 210(*b*) is electrically coupled to energy storage device 212 and LED 108.

Converter 210(*a*) performs AC to DC conversion as well as voltage conversion of a received AC electromagnetic signal from power supply 110. In particular, converter 210(*a*) receives as input an alternating current ("AC") electromagnetic signal from power supply 110 at a first voltage and generates as output a direct current ("DC") electromagnetic signal at a second voltage (not shown in FIG. 2A). The generated second voltage at the output of converter 210(*a*) is provided to an input of energy storage device 212, which establishes a storage of energy on energy storage device 212. Energy storage device 212 may be, for example, a capacitor. An output of energy storage device 212 is coupled to converter 210(*b*). Converter 210(*b*) draws energy from energy storage device 212 to power LED 108. Converter 210(*b*) performs a DC/DC conversion such that it accepts the input voltage supported by capacitor 212 and produces a regulated (and controlled) output current to LED 108. Energy storage device 212 is sized to support the output power delivered by 210(*b*) without interruption during the periodic zero-power delivery times of the AC input.

The operation of dynamic power supply 214 via converter 210(*a*), energy storage device 212, converter 210(*b*), detector 220 and voltage control system 102 to eliminate periodic flicker in LED 108 output will now be described. Cathode (not labeled in FIG. 2A) of LED 108 is coupled to detector 220. Detector 220 comprises comparator 204 and reference voltage source 206. Voltage at cathode (not labeled in FIG. 2A) of LED 108 is provided to a first input of comparator 204 in detector 220. Reference voltage source 206 is provided to a second input of comparator 204. As a function of a voltage at the cathode of LED 108 and reference voltage source 206, comparator 204 generates a control signal (not shown in FIG. 2A), which is provided to voltage control system 102.

Voltage control system 102 operates to dynamically control a voltage established on energy storage device 212 based upon a control signal generated by detector 220 such that energy storage device 212 operates at a minimum possible voltage to compensate for component variations and dimming signal variations while maintaining flicker-free operation of LED 108.

Figure 2B:
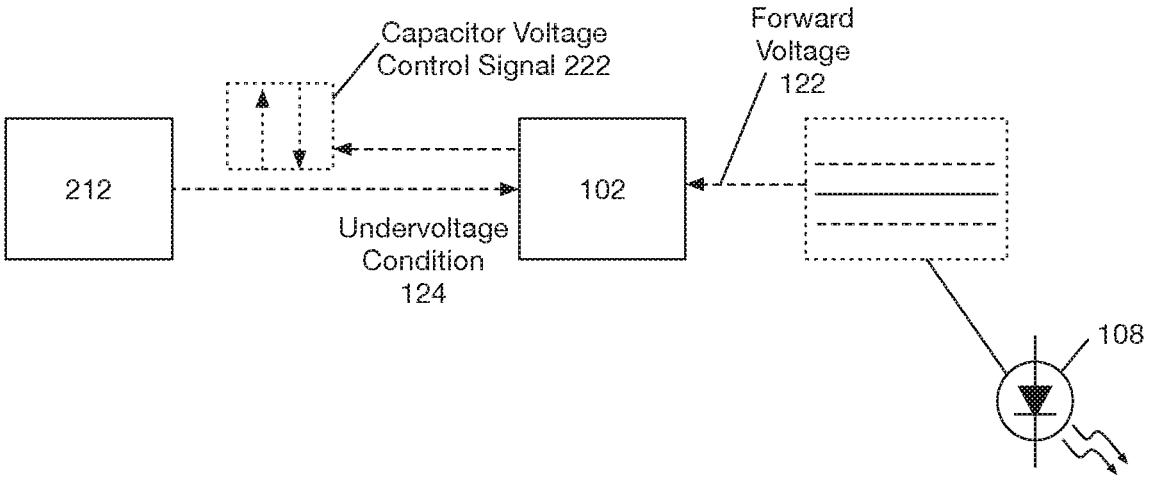
FIG. 2B depicts an overview of an operation of a voltage control system that allows an energy storage device to operate at a minimum possible voltage to compensate for component variations and dimming signal variations, while simultaneously maintaining flicker-free LED output according to one embodiment.

FIG. 2B presents an overview of an operation of a voltage control system that allows an energy storage device to operate at a minimum possible voltage to compensate for component variations and dimming signal variations, while simultaneously maintaining flicker-free LED output according to one embodiment. Based upon the received control signal, voltage control system 102 dynamically controls a voltage stored on energy storage device 212. For purposes of this discussion with respect to FIG. 2B, it is assumed that energy storage device 212 is a capacitor. However, as previously noted, energy storage device 212 is not limited to be a capacitor and may be any energy storage device As shown in FIG. 2B, voltage control system 102 receives undervoltage control signal 124 indicative of an undervoltage on energy storage device 212. Based upon undervoltage control signal 124 voltage control system 102 operates to maintain an absolute minimum voltage level specific to that lamp's particular components and thermal state on energy storage device 212 rather than maintaining an absolute level as in the prior art. Further, voltage control system 102 operates to dynamically match forward voltage 122 of LED 108 in order to effect the maximum possible efficiency of the system. An exemplary flowchart of an algorithm executed by voltage control system 102 in order to dynamically control the voltage on energy storage device 212 is described with reference to FIG. 4 below.

The control configuration depicted in FIG. 2B allows for all variables of LED 108 operation to be taken into account to maximize LED 108 life without necessitating their explicit measurement. For example, LED 108 when operated under very cool conditions will have a higher forward LED 108 voltage than when operated under hotter ambient conditions. The optimum capacitor voltage is lower for the hotter LED 108, yet with the voltage control operation of voltage control system 102 depicted in FIG. 2B no temperature measurements need to be made to achieve optimum capacitor voltage.

Likewise, LED 108 operated under cool conditions will not age capacitor 112 very quickly. Voltage control system 102 operates based upon true capacitor life rather than a conventional simple temperature-compensated elapsed-time measurement. Alternatively, as a longer-life capacitor is substituted for the original (for example, if the manufacturer makes a process improvement) voltage control operation shown in FIG. 2B will detect this change and allow LED 108 to operate longer as a result. The voltage control operation shown in FIG. 2B functions to detect the true life of the capacitor (i.e., 212) and is not based on an educated guess or simulation or extrapolation of component age.

Thus, according to one embodiment, an optimum capacitor voltage is established regardless of the forward voltage variations of LED 108 or an LED array. A conventional method would tend to make assumptions about LED voltage or implement awkward and error-prone high-side op-amp-based measurement circuits.

Another benefit of the operation of voltage control system 102 shown in FIG. 2B is that it provides for a simple but accurate way for LED 108 to change its operating mode once capacitor 112 has be exhausted. Since voltage control system 102 provides a direct measure of capacitor aging via undervoltage control signal 124 and forward voltage 122, voltage control system 102 can take capacitor 112 out of service by reverting to single-stage (stage 1 boost) operation. In this way, LED 108 can derive the added benefit of continued operation (with controlled output flicker) rather than being rendered completely inoperable, which is the conventional result.

Figure 3:
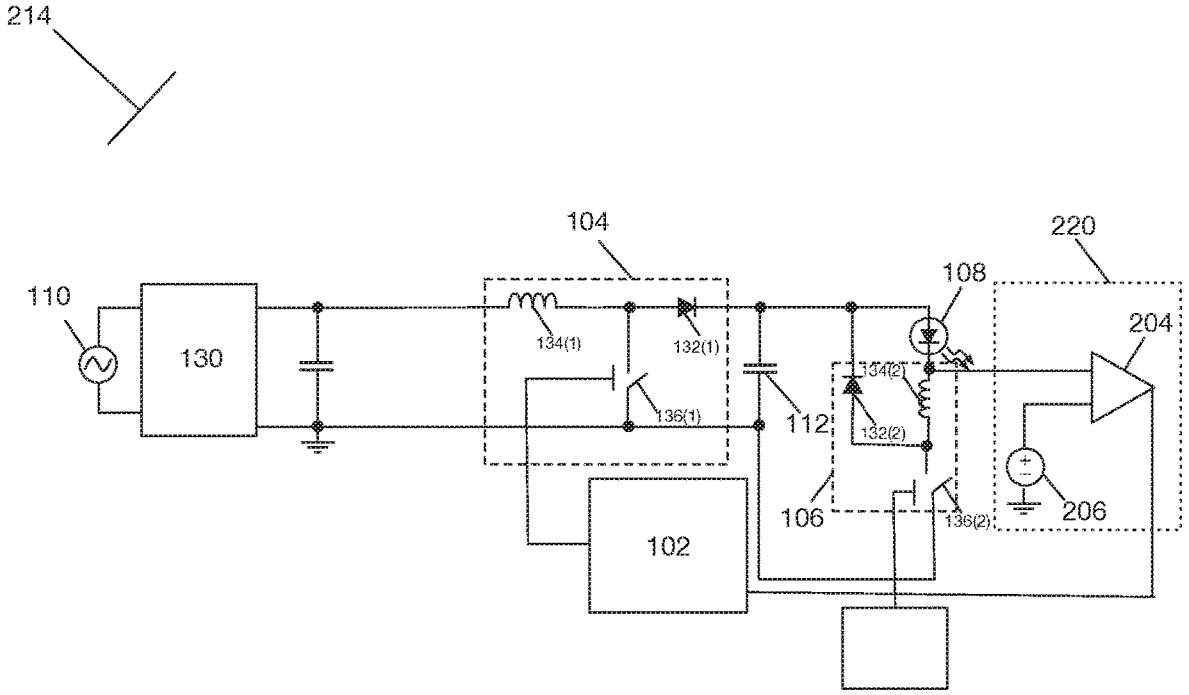
FIG. 3 is a circuit level diagram of a power supply for powering an LED according to one embodiment.

FIG. 3 is a circuit level diagram of a power supply for powering an LED with dynamic adaptation to a forward voltage of the LED according to one embodiment. Dynamic power supply 214 comprises AC/DC converter 130, boost stage 104, buck stage 106, capacitor 112, which serves as an energy storage device, detector circuit 220 and voltage control system 102. Input power source 110 provides alternating voltage ("AC") signal AC (not shown in FIG. 3). AC/DC converter 130 converts AC signal generated from input power source 110 to a DC signal (not shown in FIG. 3), which is provided to boost stage 104. Boost stage 104 further comprises inductor 134(1), diode 132(1) and switch 136(1). Boost stage 104 performs voltage conversion of DC signal generated by AC/DC converter 130 to generate an output voltage signal (not shown in FIG. 3). Boost converter 104 operates to store energy on capacitor 112. In particular, the output voltage signal from boost stage 104 is provided to capacitor 112, which stores energy in electromagnetic form. Capacitor 112 is also coupled to buck converter 106. Buck converter 106 further comprises inductor 134(2), diode 132(2) and switch 136(2). Buck converter 106 draws energy from capacitor 112 to power LED 108. Buck converter 106 may be of virtually any type (current-mode control, voltage-mode control, hysteretic control, continuous mode, discontinuous mode, or other control modes).

Detector 220 may further comprise comparator 204 and reference voltage source 206. Detector may generate an output signal (not shown in FIG. 3) that is provided to voltage control system 102. According to one embodiment, the output signal generated by comparator 204 is not a measure of LED voltage or capacitor voltage, but a measure of an undervoltage or near-undervoltage condition on capacitor 112 in relation to the forward voltage of LED 108, whatever that voltage may happen to be. According to one embodiment, in order to generate the output signal provided to voltage control system 102, comparator 204 monitors the voltage at the cathode of LED 108. An adjustable threshold to the comparator is formed by the reference voltage 206 at the positive input to comparator 206.

According to one embodiment, the aforementioned measurement by the comparator at the cathode of the LED may be performed at the anode instead provided that the positions of inductor 134(2), diode 132(2), switch 136(2) and LED 108 are permuted is a specific way. This permutation is in fact commonly effected in power supplies and LED drivers and will be understood by skilled practitioners in the art. Thus, although the embodiments described herein refer to measurement at the cathode, it will be understood that in any of these embodiments, measurement may be performed at the anode of the LED instead.

According to one embodiment, voltage control system 102 comprises a micro-controller, CPU or other processing unit capable of executing programmatic instructions. However, all-analog implementations of the invention are possible and would be apparent to anyone skilled in the art.

According to one embodiment, voltage control system 102 operates to dynamically determine and set a minimum permissible voltage on capacitor 112 such that capacitor 112 operates at a minimum possible voltage to compensate for component variations and dimming signal variations while maintaining flicker-free operation of LED 108. In particular, according to one embodiment voltage control system 102 operates to allow the input of the buck converter 106 (the minimum capacitor voltage) to be controlled to be just above the instantaneous operating voltage of LED 108. According to one embodiment, voltage control system 102 operates to perform a continual monitoring and adjusting of capacitor 112 voltage utilizing an operation scheme such as that shown in FIG. 2B. This operation scheme may be achieved, for example, by firmware control algorithms residing on voltage control system 102 so as to uniquely tailor and optimize LED operation.

According to one embodiment, voltage control system 102 operates as a linear feedback control system which monitors the output signal generated by comparator 204 and produces a control output (not shown in FIG. 3), which is used to adjust capacitor 112 voltage either up or down as needed to maintain minimum acceptable voltage. In particular, referring to FIG. 3, voltage control system 102 may, via the output signal generate by comparator 220, monitor the cathode (negative terminal) of LED 108 in relation to its proximity to 0 Volts. In particular, voltage control system 102 may operate to detect and monitor the voltage at the negative terminal of LED 108 in relation to reference voltage 206, and based upon this comparison voltage control system 102, may set and maintain a minimum voltage on capacitor 112, just above the instantaneous operating voltage of LED 108. According to one embodiment, voltage control system 102 may measure this voltage difference directly (via comparator 204 and reference voltage source 206) or by monitoring secondary characteristics such as frequency of switch 136(2).

Figure 4:
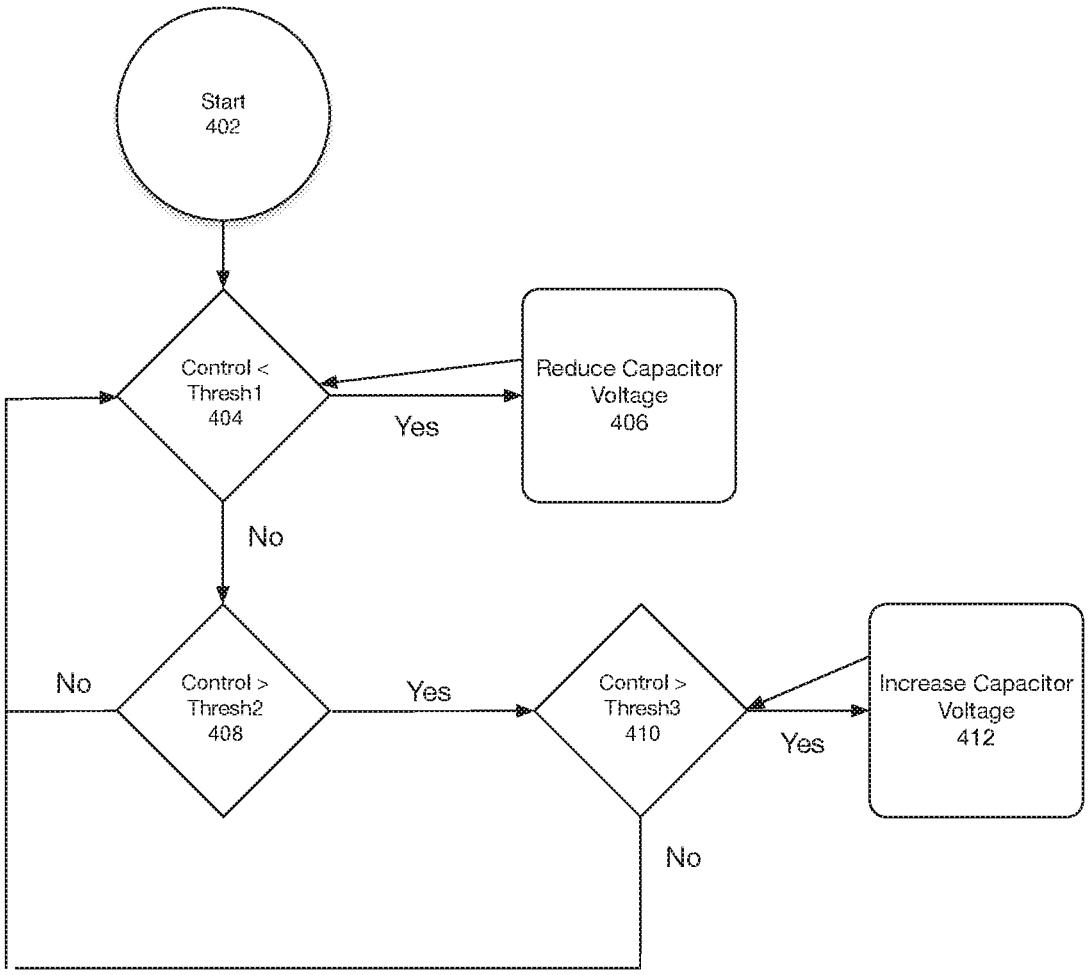
FIG. 4 is a flowchart depicting an algorithm executed by a voltage control system according to one embodiment.

As will be further described with respect to FIG. 4, voltage control system 102 may operate to very slowly lower capacitor 112 voltage until there is an indication from detector 220 via the output signal of detector 220. Once this indication occurs, further reductions of capacitor 112 voltage are not performed. If there is an excessively high signal coming from detector 220 (an indication that the voltage is too low for flicker-free operation to occur), then capacitor 112 voltage is increased until the indication is just present but barely so. In this way, the absolute minimum capacitor 112 voltage is maintained but not at an absolute level. In this way, voltage control system 102 dynamically matches the voltage on capacitor 112 to the forward voltage of LED 108 in order to bring about operation at the maximum possible efficiency for the system. According to an alternative embodiment, the frequency of switch 136(2), which may be implemented as an FET ("Field Effect Transistor") is monitored. This embodiment may be used when buck converter 106 is implemented with a hysteretic control configuration because its switching frequency is directly related to the input-output voltage difference and other parameters.

According to one embodiment, voltage control system 102 may function to determine whether capacitor 112 has reached its end-of-life and if so disable two-stage operation by disabling buck converter 106. According to one embodiment, an end-of-life condition may be detected when the minimum allowable capacitor 112 voltage signal can no longer be inhibited by increasing the voltage. When this condition persists for a short but sustained period of time, capacitor 112 is determined to have reached it end of life. This may be accomplished by determining whether the voltage on capacitor 112 can be reduced (as with a fresh capacitor) or whether the voltage needs to be increased beyond a threshold (as would be the case with a nearly exhausted capacitor). Once capacitor 112 has reached the end of its useful life, switch 136(2) on buck stage 106 may permanently closed such that voltage control system 102 is disabled. In this way the lamp is made to revert to single-stage operation the single stage simply draws a fixed average current or power level from the power source.

FIG. 4 is a flowchart depicting an algorithm executed by a voltage control system according to one embodiment. As shown in FIG. 4, the process is initiated in 402. In 404, the control signal generated by comparator 204 is compared with a first threshold. If the control signal is lower than the first threshold (Yes' branch of 404) in 406, capacitor voltage 112 is reduced until it falls below the first threshold. Otherwise (No' branch of 404), in 408 the control signal is compared with a second threshold. If the control signal exceeds the second threshold voltage (Yes' branch of 408), in 410 the control signal is compared with a third threshold voltage. If the control signal exceeds the third threshold (Yes branch of 410), in 412, capacitor 112 voltage is reduced until the control signal exceeds the third threshold. Otherwise (No' branch of 412 and 'No' branch of 412), control continues with 404.

In the absence of methodologies described, typical efficiencies of a two stage LED driver might be 75%. Utilizing techniques of the dynamic power supply described herein, this efficiency is increased to 83%. Further systematic optimization of embodiments may further raise the efficiency, for instance to 85%, 90%.

Figure 5:
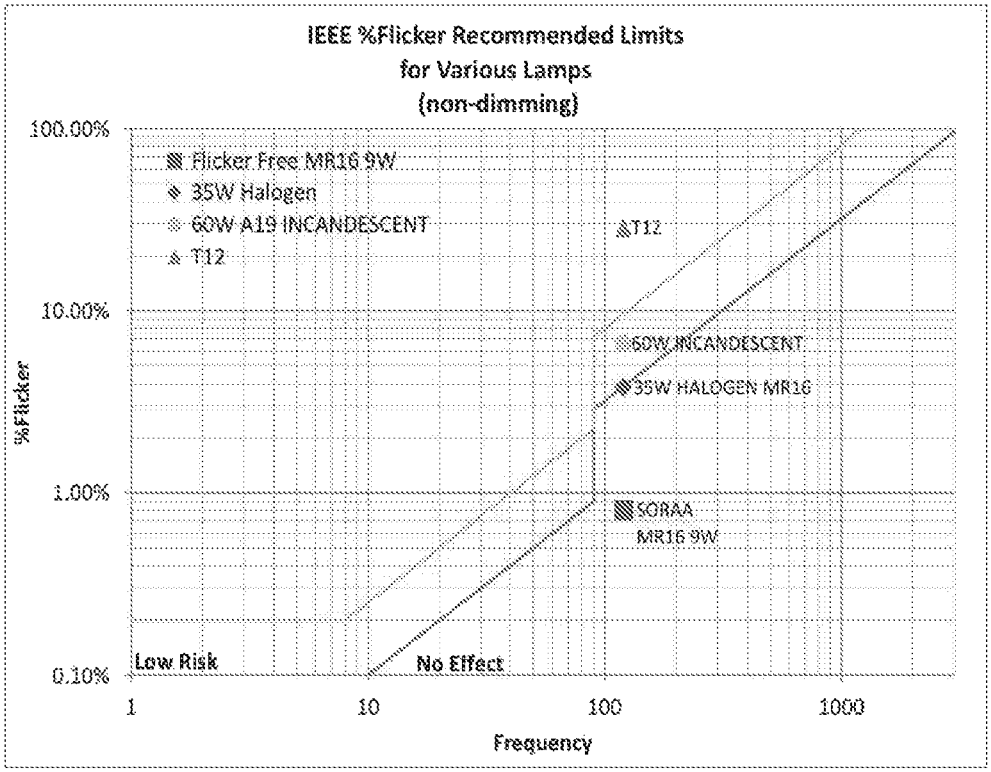
FIG. 5 is a comparison plot showing the relative flicker of three common technologies in relation to the relative flicker achievable utilizing one embodiment of the invention.

FIG. 5 is a comparison plot showing the relative flicker of three common technologies in relation to the relative flicker achievable utilizing one embodiment of the invention. FIG. 5 shows the relative flicker of 3 common technologies in comparison with the methodologies of the present invention described herein. In a 1-stage arrangement, the MR16 was at 100% flicker at a frequency of 120 Hz (this is not depicted on the plot of FIG. 5). Conventional filament technology (incandescent, halogen) has approximately 4-7% flicker.

In contrast, embodiments of the invention described herein achieve less than 1% flicker. FIG. 5 also indicates boundaries, as recommended by IEEE, for regions having low risk or no effect relating to stroboscopic flicker. Filament sources are in the low risk zone, whereas embodiments described herein fall within the the no-effect zone. The T12 fluorescent source is above the low-risk boundary. In addition, conventional LED sources are frequently above the no-risk boundary. Other embodiments of the invention may remain below the no-effect boundary. In some embodiments, the tradeoff between the efficiency of the driver and the flicker degree is optimized to achieve a maximum efficiency while remaining below a predetermined value of flicker degree.

In addition, embodiments of the invention may be optimized by considering various metrics of stroboscopic flicker. This includes percent flicker (as discussed above), flicker index, modulation depth, Stroboscopic effect Visibility Measure (SVM) and others. In an embodiment, a selected metric for flicker (or a combination of metrics) is chosen and a criterion is set for a maximum value for the metric. According to one embodiment, a design process is employed to maximize electrical efficiency while meeting the desired criterion. This design method relates to designing a two-stage driver according to embodiments of the invention described herein. In some embodiments, an optimization is performed to maintain a predetermined flicker value upon dimming of the LED (for instance, at 10% dimming 1% dimming and so on).

Embodiments of the invention can be employed in a variety of systems employing light-emitting sources. This includes lighting systems (such as lamps and fixtures), display and IT systems (such as computer screens, phone screens etc.), automotive applications and so on. The light-emitting sources may be light-emitting diodes (LEDs) as described herein; they may also be laser diodes or other light sources.

Some embodiments utilizing light-emitting sources include a plurality of light-emitting sources. In some cases, the light-emitting sources are distributed among several electrical strings, which can be driven with independent electrical powers. In some embodiments, the electrical power feeding each string can be varied (for instance over time according to a predetermined schedule, or following the input from a control system which may be controlled by a user or by an external stimulus). In some embodiments, the various strings may emit different light spectra (having different chromaticity, CCT, color rendition properties, and so on). In some embodiments, the electrical signal delivered by the two-stage driver is configured to obtain a predetermined flicker value, or operate the light sources at a selected efficiency.

Previous embodiments are described in the context of applications to LED drivers. However, embodiments of the invention can be used in other systems to drive a variety of electrical and electronic devices. In general, embodiments of the invention can provide various advantages: increased efficiency (by operating the device in a desirable voltage range), reduced transient effects (by reducing waveform variations sent to the device), increased lifetime (by operating the device in a desirable voltage range). Devices whose properties (efficiency, lifetime, etc.) are dependent on the input voltage or power can thus benefit from the techniques described herein. The techniques described herein achieved reduced heating of the circuitry. This allows for the life extensions of components, lower operating temperatures, etc. Any multi-stage power conversion device which must operate in a thermally stressed environment could benefit. Examples may include industrial motor drives, automotive drive train power converters, military equipment operating in hot areas.

Finally, it should be noted that there are alternative ways of implementing the embodiments disclosed herein. Accordingly, the present embodiments are to be considered as illustrative and not restrictive, and the claims are not to be limited to the details given herein, but may be modified within the scope and equivalents thereof.

What is claimed is:

1. A power supply for powering a light emitting diode ("LED"), wherein said LED has a forward voltage when operating, wherein said forward voltage changes during operation, said power supply comprising:

a boost circuit configured for increasing power from a first voltage to a second voltage;

a capacitor coupled to said boost circuit to receive said power at said second voltage, said capacitor having a capacitor voltage when charged;

a buck circuit coupled to said capacitor and said LED and configured to draw current from said capacitor and deliver a fixed and regulated current to said LED; and a voltage regulation circuit for adjusting said power received by said capacitor to maintain said capacitor voltage just above said forward voltage as said forward voltage changes, wherein said voltage regulation circuit is configured to monitor said forward voltage directly from said LED;

a comparator for receiving as input a voltage established on a terminal of said LED and a reference voltage source and generating a control signal;

wherein said voltage regulation circuit is configured to monitor said forward voltage and control said capacitor voltage such that said capacitor voltage just exceeds said forward voltage based on said control signal, wherein said voltage regulation circuit is configured to control said capacitor voltage by decreasing said capacitor voltage when said control signal is below a first threshold, and increasing said capacitor voltage when said control signal is above a second threshold, wherein said first and second threshold are established such that said capacitor voltage is maintained just above said forward voltage.

2. The power supply of claim 1, wherein said voltage regulator circuit is configured to control the output of said boost circuit to control said power received by said capacitor.

3. The power supply of claim 2, wherein said voltage regulator circuit is configured to control the output of said boost circuit by turning said boost circuit on and off.

4. The power supply of claim 1, wherein said voltage regulator circuit is configured to control the output of said buck circuit to control said fixed and regulated current to said LED.

5. The power supply of claim 4, wherein said voltage regulator circuit is configured to control the output of said buck circuit such that said buck circuit operates only when said capacitor voltage exceeds said forward voltage.

6. The power supply of claim 4, wherein said voltage regulator circuit is configured to control the output of said buck circuit by turning said buck circuit on and off.

7. The power supply of claim 1, wherein said voltage regulation circuit is configured to operate said boost circuit and said buck circuit in a bypass mode in which said capacitor is bypassed.

8. The power supply of claim 6, wherein said voltage regulation circuit is configured to disable said second voltage converter based on a determination that said capacitor satisfies an end-of-life condition.

9. The power supply of claim 7, wherein, in said bypass mode, said LED receives power directly from said boost circuit.

10. The power supply of claim 9, wherein, in said bypass mode, said voltage regulation circuit is configured to disable said buck circuit.

11. The power supply of claim 2, wherein said voltage regulation circuit is configured to monitor said forward voltage based on a secondary characteristic.

12. The power supply of claim 11, wherein said secondary characteristic is the frequency at which said buck circuit is turned on and off.

13. The power supply of claim 2, further comprising:

a converter configured for receiving AC power and converting it to DC power having said first voltage.

14. The power supply of claim 13, wherein said capacitor is configured to store sufficient energy for said second voltage converter to deliver said regulated current without interruption during the periodic zero-power deliver times of said AC power.

15. A method for powering a light emitting diode ("LED") having a forward voltage, said method comprising:

(a) charging a capacitor with a boost circuit to establish a capacitor voltage on said capacitor;

(b) drawing current from said capacitor and delivering a regulated current to said LED when said capacitor voltage exceeds said forward voltage;

(c) monitoring said forward voltage;

(d) maintaining said capacitor voltage just above said forward voltage by (i) reducing said charging of said capacitor in step (a) if said capacitor voltage is more than just above said forward voltage, or (ii) increasing said charging of said capacitor in step (a) if said capacitor voltage is below said forward voltage; and (e) bypassing said capacitor and supplying said LED with power from said boost circuit if an end-of-life condition of said capacity is detected, wherein step (e) comprises at least (i) measuring a voltage established on a cathode of said LED;

(ii) comparing said voltage established on said cathode of said LED with a reference voltage to generate a control signal; and (iii) disabling said energy storage device and providing a fixed average current to said LED when said control signal remains an undervoltage control signal during a period during which said energy storage device is driven by a voltage converter.

* * * * *